US006568677B2

(12) United States Patent
Brenner

(10) Patent No.: US 6,568,677 B2
(45) Date of Patent: May 27, 2003

(54) POKER GAME USING TOSSED BALLS

(75) Inventor: Max Brenner, Encino, CA (US)

(73) Assignee: The Original Products Company, L.L.C., Los Angeles, CA (US)

( * ) Notice: Subject to any disclaimer, the term of this patent is extended or adjusted under 35 U.S.C. 154(b) by 0 days.

(21) Appl. No.: 09/916,899

(22) Filed: Jul. 26, 2001

(65) Prior Publication Data

US 2003/0020235 A1 Jan. 30, 2003

(51) Int. Cl.[7] ..... A63B 71/00

(52) U.S. Cl. ..... 273/144 B; 273/144 A; 273/144 B; 273/274; 273/269; 273/292

(58) Field of Search ..... 273/144 B, 274, 273/292, 138 R, 148 R, 269, 144 R, 145 A, 145 B, 145 CA, 145 D, 144 A

(56) References Cited

U.S. PATENT DOCUMENTS 4,249,742 A * 2/1981 Vergara et al. ..... 273/144 B
4,948,128 A * 8/1990 Emery et al. ..... 473/17
5,100,141 A * 3/1992 Fitch ..... 273/145 B
5,102,138 A * 4/1992 Johnson ..... 273/142 E
5,118,114 A * 6/1992 Tucci ..... 273/274
5,248,142 A * 9/1993 Breeding ..... 273/138.1
5,257,784 A * 11/1993 Boylan et al. ..... 273/144 B
5,265,877 A * 11/1993 Boylan et al. ..... 273/139
5,611,729 A * 3/1997 Schumacher et al. ..... 463/18
5,695,188 A * 12/1997 Ishibashi ..... 273/143 R
5,743,800 A * 4/1998 Huard et al. ..... 463/12
5,845,903 A * 12/1998 Sloan ..... 273/144 R
6,050,895 A * 4/2000 Luciano et al. ..... 463/20
6,079,711 A * 6/2000 Wei et al. ..... 273/269
6,145,836 A * 11/2000 Toulemonde et al. ... 273/144 R
6,152,448 A * 11/2000 Cudlipp ..... 273/144 R
6,186,505 B1 * 2/2001 Perrie et al. ..... 273/236
6,267,669 B1 * 7/2001 Luciano et al. ..... 273/269
6,276,689 B1 * 8/2001 Brown ..... 273/236
6,315,664 B1 * 11/2001 Baerlocher et al. ..... 273/138.1
6,368,212 B1 * 4/2002 Moody ..... 273/138.1
6,398,645 B1 * 6/2002 Yoseloff ..... 273/269
6,450,884 B1 * 9/2002 Seelig et al. ..... 463/17

* cited by examiner

*Primary Examiner*—Benjamin H. Layno
*Assistant Examiner*—Dolores Collins
(74) *Attorney, Agent, or Firm*—Matthew F. Jodziewicz

(57) ABSTRACT

A poker game using a playing surface for placing wagers that correspond to player selected poker hands. A plurality of balls are tossed into a hopper that directs the tossed balls to a surface that has a plurality of card positions. Each of the card positions are adapted to receive and retain a tossed ball and represent the playing cards of a poker deck and a joker. The card positions indicate cards that are selected by operation of the players tossing balls into the hopper and having the tossed balls being retained in the card positions.

22 Claims, 1 Drawing Sheet

POKER GAME USING TOSSED BALLS

BACKGROUND OF THE INVENTION

1. Field of the Invention

The present invention relates to gaming, and more particularly pertains to a variations of the games of poker using player tossed balls to indicate card hands.

2. Description of the Prior Art

The art of gaming is constantly looking for novel and exciting games that entice and reward the bettor not only with a monetary payout, but with a heightened feeling of excitement that encourages further play.

The card game of poker is well known throughout history and has played a prominent role in gaming. However, being an old and well played game, its allure has faded in relation to the newer games. Many people have come to consider poker as being passe, a game for knowledgeable card sharks and one that is weighted against the novice or non-professional player. With a reputation such as this, deserved or not, participation in the game has declined over the years, especially in light of the more modern games that offer easy to understand rules and offer even the newest beginner an opportunity to participate on an equal footing with seasoned veterans.

Accordingly, gaming interests have sought ways and methods of "enlivening" the game of poker to restore it to its old allure and stature. Among these attempts are U.S. Pat. No. 4,149,728 issued Apr. 17, 1979 to Thompson for a Poker Game Using a Roulette Wheel, or U.S. Pat. No. 3,649,023 issued March 1972 to Schohm for a Method of Playing a Game Where Cards Cover Board Selections, or U.S. Pat. No. 3,998,462 issued December 1976 to Goott for Poker Type Game Apparatus, or U.S. Pat. No. 4,043,560 issued August 1977 to Blackman for Board Game Employing Tiles and Color Coded Dice, or even hybrid games that attempt to combine poker and pool.

However, none of these references offer the simplicity and extent of player participation that is found in the present poker game as described and claimed herein.

At least in these respects, the poker game of the present invention substantially departs from the conventional concepts, apparati and designs of the prior art, and in so doing provides a game, gaming apparatus and method primarily developed for the purpose of providing a participant with greater reward and excitement in participating than that currently available for players of the game of poker.

Therefore, it can be appreciated that there exists a continuing need for a new and improved poker game suitable for play and gaming purposes which can be used for providing a game that allows for a more participation by novices to the game without a fear of being overwhelmed by senior, seasoned players that overcomes the limitations of existing poker games as to this and other aspects of existing poker games as is better described below.

In this regard, at least, the present invention substantially fulfills this need.

SUMMARY OF THE INVENTION

In view of the foregoing disadvantages inherent in the known types of poker games now present in the art, the present invention provides an improvement. As such, the general purpose of the present invention, which will be described subsequently in greater detail, is to provide a new and improved game of poker and apparatus for playing this improved poker game, which has all the advantages of the prior art and none of the disadvantages.

To attain this, the present invention, as found in an embodiment of game apparati for playing a game of poker, generally comprises a playing surface for placing and indicating bets or wagers that correspond to player selected poker hands. A plurality of balls, for example, 5, 7 or any number of balls, depending on the type of poker or other card game being played, for example, poker games such as five card stud or seven card call poker, are given to individual players. A hopper, basket or container is positioned for receiving the balls tossed thereinto by the players. The hopper acts as a funnel or conduit, randomly directing the tossed balls to a surface that has a plurality of card positions noted thereon, for example, 53 holes representing a card deck and joker. Each of the card positions is adapted to receive and retain a tossed ball. The card positions represent the playing cards of a poker deck and a joker. The card positions indicate the equivalent of deck dealt cards by operation of player tossed balls being retained therein.

The present invention is also found embodied in a method of playing a poker game that includes, at least, the steps of:

providing a playing surface for placing bets or wagers that corresponds to player selected poker hands;

having selected players toss a plurality of balls into a hopper that randomly directs the tossed balls to a surface that has a plurality of card positions adapted to receive and retain a tossed ball. The card positions represent the playing cards of a poker deck and a joker. The card positions where player tossed balls are retained indicate the equivalent of dealt cards in a hand of poker with or without a joker card.

Alternate embodiments!of the invention are also disclosed and taught in the discussion below including, but not limited to, embodiments where additional elements or steps are added to heighten player excitement or participation.

The present invention may be embodied in home board games for both children and adult play, and the wagers and payouts may include both monies, prizes, chits or any other type of reward.

There has thus been defined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention, such as gambling games utilizing cards, number or other known or arbitrary signs and symbols, tic-tac-toe for example.

It is therefore an object of the present invention to provide a new and improved poker game, and other games of chance, which has all the advantages of the prior art games and none of the disadvantages.

It is another object of the present invention to provide a new and improved poker game, which may be easily and efficiently established, learned and played.

It is a further object of the present invention to provide a new and improved poker game which utilizes gaming components which are of a durable and reliable construction.

An even further object of the present invention is to provide a new and improved poker game whose rules and structure is simplified, while permitting a player greater excitement and participation in its playing.

An additional object of the present invention is to provide a game in which multiple participants can simultaneously engage in playing the game.

Lastly, it is an object of the present invention to provide a new and improved poker game and gaming apparatus, which may be played at home or in a professional setting of a gaming house.

These together with other objects of the invention, along with the various features of novelty that characterize the invention, are pointed out with particularity in the claims anexed to and forming a part of this disclosure. For a better understanding of the invention, its operating advantages, and the specific objects attained by its use, reference should be had to the accompanying drawings and descriptive matter in which there is an illustrated preferred embodiments of the invention.

BRIEF DESCRIPTION OF THE DRAWINGS

The invention will be better understood and objects, other than those set forth above, will become apparent when consideration is given to the following detailed description thereof. Such description makes reference to the annexed drawings wherein.

Similar reference characters and numberals refer to similar parts throughout the drawings.

DESCRIPTION OF THE PREFERRED EMBODIMENT

Figure 1:
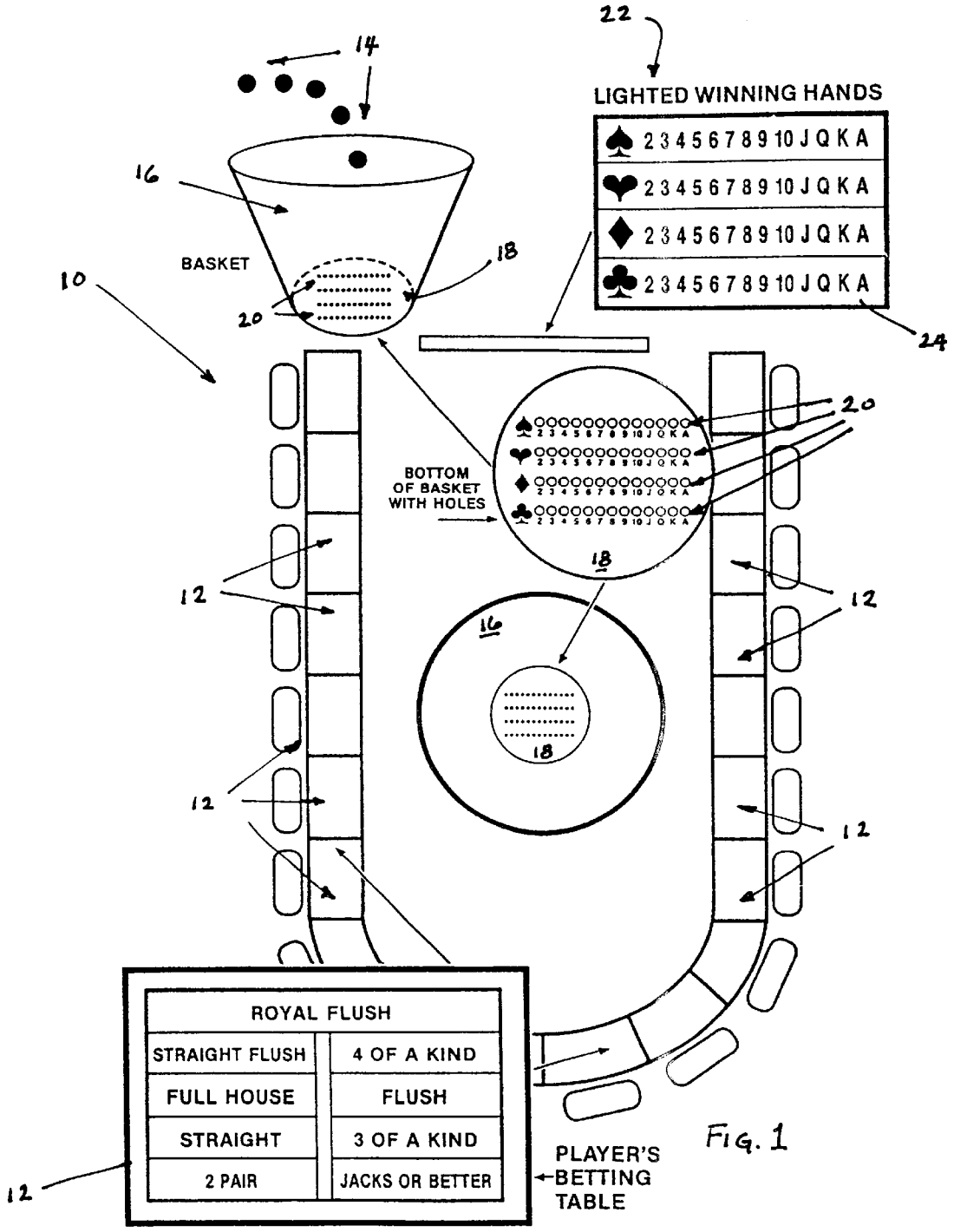
FIG. 1 is an idealized diagram of an embodiment of a gaming configuration constructed in accordance with the principles of the present invention for the playing of the poker game of the present invention.

With reference being made now to the drawings, and in particular in FIG. 1 thereof, a new and improved game of poker embodying the principles and concepts of the present invention and generally designated by the reference numeral 10 will be described.

A poker game embodying the present invention comprises a playing surface 12 for placing bets corresponding to selected poker hands, such as royal flush, straight flush, full house, straight, etc., as is shown in the enlarged area of FIG. 1 normally found in a game of poker. Various odds for the bets, as determined by the house or mathematically, may be shown directly on the playing surface 12 to assist the player in selecting his bets.

There may be multiple such playing surfaces 12 to accommodate a number of simultaneous players. The arrangement of such playing surfaces 12 may also be selected for aesthetic, ergonomic or psychological reasons to aid in playing the game or to enhance the enthusiasm and enjoyment of the players. For example, playing surfaces 12 may be formed into an oval, rectangle or even a horseshoe shape that surrounds hopper 16 described more fully below. The arrangement selected should, however, provide for easy player access to hopper 16 and to any house dealer moderating the game.

There are a plurality of balls 14 that are available for use in playing the game as better described below. These are preferably of the lightweight type found in table tennis games but may also include heavier types of balls. The balls must be uniform in construction but may vary in visual appearance. In any event, the balls should be pleasing to a player from both a visual and tactile aspect.

A hopper 16 is both adapted and positioned with respect to the game players to receive balls tossed thereinto by the players. Hopper 16 may be of any pleasing and attractive shape, but must act as a funnel to direct randomly the balls 14 tossed into it, to a surface 18 that is delimited into a plurality of sections or card positions 20.

The balls must randomly approach surface 18 so as to present a true random distribution of their entering any one of the card positions 20. Interposed between hopper 16 and surface 18 may be any number of aesthetically pleasing or psychologically selected routes or detours, such as those rebounding banks and posts found in games such as pinball, selected to enhance the players' enjoyment in tossing a ball 14 into hopper 16.

Each of the card positions 20 is adapted to receive and retain a single tossed ball at a time. This may be accomplished by an electrical or mechanical sensor mechanism tripped by impact with a tossed ball, or by forming generally concave depressions in the surface 18 capable of receiving and retaining a single ball therein. Card positions 20 represent the playing cards of a poker deck and a joker normally used in playing a game of poker. Card positions 20 indicate cards selected by operation of tossed balls 14 being retained therein and correspond to a poker hand of cards dealt from a deck of cards.

As there may be multiple simultaneous players of the game, in order to provide each player with the maximum opportunity to follow both the path of the tossed balls 14 and their eventual resting place on surface 18, a display 22 is provided and positioned to indicate the cards selected by operation of balls 14 tossed into hopper 16 and retained in card positions 20 on surface 18. One such preferred display 22 is a visually lighted board 24 that displays the selected cards to the players and may include flashing lights and other aesthetically pleasing and informative visual indicia.

In order to further increase the players enthusiasm and enjoyment in playing the game, it is also preferred that an audible alarm or voice be incorporated into the game that further indicates the cards selected by operation of balls 14 tossed into hopper 16 and retained in card positions 20.

Both the visual display and audible alarm are preferably coordinated to signify not only the selected cards, but to notify players of a game winner which could pay out all at the table or none.

All of the wagers and selected cards may be calculated by mechanical devices or electronic circuitry, such as a computer, to keep track of an individual player's wagers to avoid human error and to provide the players with a level of confidence that they are playing an honest game.

The present invention is also embodied in a method of playing a poker game that at least comprises the steps of:

providing a playing surface, such as surface 12 described above, for placing bets or wagers corresponding to selected poker hands along with a plurality of balls, such as those balls 14 also described above.

tossing the balls into a hopper;

directing the tossed balls to a surface having a plurality of card positions adapted to receive and retain a tossed ball. The card positions represent the playing cards of a poker deck and a joker and indicate selected cards by retaining tossed balls therein.

In addition to these steps, the method of playing the game may further comprise the step of visually indicating the cards selected by operation of balls tossed by a player into the hopper which are retained in the card positions.

Furthermore, a method of playing a poker game also embodying the present invention may further comprise the step of audibly indicating the cards selected by operation of balls tossed by the game players into the hopper and retained in the card positions.

Coordinating both the visual display and audible alarm to signify not only the selected cards, but to notify players of a game winner is also contemplated to be within the scope of the method of this invention. Interaction between game play and the participants is highly desired to increase interest and enjoyment of the game for the participants.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A poker game comprising:

a playing surface for placing bets corresponding to selected poker hands;

a plurality of balls;

a hopper having an opening for receiving said plurality of balls tossed thereinto by a game player and randomly directing said tossed balls to a surface having a plurality of card positions, each of said card positions adapted to receive and retain a tossed ball, said card positions representing the playing cards of a poker deck and a joker, said card positions indicating cards selected by operation of tossed balls being retained therein.

2. A poker game as in claim 1 wherein said card positions are formed in said surface as generally concave depressions.

3. A poker game as in claim 1 further comprising:

a plurality of playing surfaces to accommodate multiple game players.

4. A poker game as in claim 1 wherein said playing surface surrounds said hopper.

5. A poker game as in claim 4 wherein said playing surface is generally oval in shape.

6. A poker game as in claim 4 wherein said playing surface is generally rectangular in shape.

7. A poker game as in claim 4 wherein said playing surface is generally horseshoe in shape.

8. A poker game as in claim 1 further comprising:

a display for indicating the cards selected by operation of balls tossed into said hopper and retained in said card positions.

9. A poker game as in claim 8 wherein said display is a visually lighted board displaying the selected cards.

10. A poker game as in claim 1 further comprising:

electronic circuitry means responding to balls tossed into said hopper and retained in said card positions, for audibly indicating the card positions selected by said tossed balls.

11. A method of playing a poker game comprising the steps of:

providing a playing surface for placing bets corresponding to selected poker hands and a plurality of balls;

tossing said plurality of balls into a hopper having an opening for receiving said plurality of balls tossed thereinto by a game player and adapted to received said tossed balls; and randomly directing said tossed balls to a surface having a plurality of card positions adapted to receive and retain a tossed ball, said card positions representing the playing cards of a poker deck and a joker and indicating selected cards by retaining tossed balls therein.

12. A method of playing a poker game, as in claim 11, further comprising the step of:

visually indicating the cards selected by operation of balls tossed into said hopper and retained in said card positions.

13. A method of playing a poker game, as in claim 11, further comprising the step of:

audibly indicating by means of electronic circuitry responding to balls tossed into said hopper and retained in said card positions, the card positions selected by said tossed balls.

14. A game of chance comprising:

a playing surface for placing bets corresponding to player selected wagers;

a plurality of balls;

a hopper having an opening for receiving said plurality of balls tossed thereinto by a game player and randomly directing said tossed balls to a surface having a plurality of wager positions, each of said wager positions adapted to receive and retain a tossed ball, said wager positions representing the wagers presented to a player for selection, said wager positions indicating winning wagers selected by operation of tossed balls being retained therein.

15. A game of chance as in claim 14 wherein said wager positions are formed in said surface as generally concave depressions.

16. A game of chance as in claim 14 further comprising:

a plurality of playing surfaces to accommodate multiple game players.

17. A game of chance as in claim 14 wherein said playing surface surrounds said hopper.

18. A game of chance as in claim 17 wherein said playing surface is generally oval in shape.

19. A game of chance as in claim 17 wherein said playing surface is generally horseshoe in shape.

20. A game of chance as in claim 14 further comprising:

a display for indicating the winning wager positions selected by operation of balls tossed into said hopper and retained in said wager positions.

21. A game of chance as in claim 19 wherein said display is a visually lighted board displaying the selected winning wager positions.

22. A game of chance as in claim 14 further comprising:

electronic circuitry means responding to balls tossed into said hopper and retained in said wager positions, for audibly indicating the winning wager positions selected by said tossed balls.

* * * * *